US006523758B1

(12) United States Patent
de Vulpillieres

(10) Patent No.: US 6,523,758 B1
(45) Date of Patent: Feb. 25, 2003

(54) FUEL INJECTOR NEEDLE LOWER GUIDE DISK

(75) Inventor: Didier J. de Vulpillieres, Williamsburg, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 6 days.

(21) Appl. No.: 09/685,703

(22) Filed: Oct. 10, 2000

Related U.S. Application Data

(60) Provisional application No. 60/186,573, filed on Mar. 2, 2000.

(51) Int. Cl.[7] ..... F02M 61/10
(52) U.S. Cl. ..... 239/533.11; 239/596
(58) Field of Search ..... 239/533.11, 533.12, 239/533.14, 533.2, 553, 553.3, 553.5, 596, 601, 590, 590.3, 590.5; 251/129.15

(56) References Cited

U.S. PATENT DOCUMENTS 6,039,272 A * 3/2000 Ren et al. ..... 239/597
6,170,764 B1 * 1/2001 Muller et al. ..... 239/533.12

* cited by examiner

*Primary Examiner*—Lisa A. Douglas

(57) ABSTRACT

A fuel injector is provided. The fuel injector includes a fuel metering member having first and second ends disposed along a longitudinal axis, a seat located within the fuel metering member proximate the second end, and a needle reciprocably disposed within the fuel metering member. The needle has a longitudinal needle axis. The fuel injector also includes a guide disposed within the fuel metering member proximate to the seat. The guide includes a generally planar disk having a first surface, a second surface, and an outer perimeter. The guide also includes a generally concentric central opening extending therethrough. The central opening is sized to allow the reciprocating element to reciprocate therein. The guide also includes at least one inner opening extending between the first and second surfaces from the central opening toward the outer perimeter. The at least one inner opening extends generally parallel to the longitudinal axis. A method of evacuating vapor bubbles proximate a valve seat in a fuel injector is also provided.

18 Claims, 3 Drawing Sheets

FUEL INJECTOR NEEDLE LOWER GUIDE DISK

CROSS-REFERENCE TO RELATED APPLICATION

The present application claims the benefit of U.S. Provisional Application No. 60/186,573, filed Mar. 2, 2000.

FIELD OF THE INVENTION

The present invention relates to guide disks used to guide a lower end of a fuel injector needle during operation.

BACKGROUND OF THE INVENTION

A number of prior art fuel injectors include a lower needle guide which guides a downstream end of a fuel injector needle during operation. The lower needle guide is located directly above the fuel injector valve seat and helps to maintain axial concentricity of the needle with respect to the valve seat. During manufacture of the fuel injector, the disk is fixedly connected to the valve seat, preferably by welding, crimping, or some other known technique.

In some cases, the lower guide is made from a thin disk in which a carefully dimensioned central opening has been formed, through which the injector needle reciprocates during operation, and in which an additional series of flow openings is formed radially around the central opening. The purpose of these openings is to allow fuel to flow through the lower guide without restricting that fuel flow.

However, dead spots where fuel does not flow tend to form in areas immediately downstream of the lower guide around the central opening and the flow openings. During hot fuel operations, after the fuel injector has been left soaking on a hot temperature engine, fuel in the injector downstream of the lower guide can start vaporizing, creating fuel bubbles which can be difficult to eliminate when the fuel system is restarted.

Additionally, the flow openings can force the fuel to flow around corners, which can induce unwanted turbulence which can add to bubble formation in that area.

It would be beneficial to provide a lower guide disk which does not trap fuel on a downstream side of the disk, thus eliminating vaporized fuel and reducing turbulence downstream of the disk.

BRIEF SUMMARY OF THE PRESENT INVENTION

Briefly, a fuel injector is provided. The fuel injector comprises a fuel metering member having first and second ends disposed along a longitudinal axis, a seat located within the fuel metering member proximate the second end, and a needle reciprocably disposed within the fuel metering member. The needle has a longitudinal needle axis. The fuel injector also comprises a guide disposed within the fuel metering member proximate to the seat. The guide includes a generally planar disk having a first surface, a second surface, and an outer perimeter. The guide also includes a generally concentric central opening extending therethrough. The central opening is sized to allow the reciprocating element to reciprocate therein. The guide also includes at least one inner opening extending between the first and second surfaces from the central opening toward the outer perimeter. The at least one inner opening extends generally parallel to the longitudinal axis.

Further, the present invention provides a fuel injector comprising a fuel metering member having first and second ends disposed along a longitudinal axis, a seat located within the fuel metering member proximate the second end, and a needle reciprocably disposed within the fuel metering member. The needle has a longitudinal needle axis. The fuel injector also comprises a guide disposed within the fuel metering member proximate to the seat. The guide includes a generally planar disk having a first surface, a second surface, and an outer perimeter being secured to the fuel metering member. The guide also includes a generally concentric central opening extending therethrough. The central opening guides the needle. The guide also includes at least one opening extending between the first and second surfaces. The at least one opening at the first surface is disposed at a first longitudinal distance from the seat opening, and the outer perimeter is disposed at a second longitudinal distance from the seat opening. The first distance is greater than the second distance.

A method of evacuating vapor bubbles proximate a valve seat in a fuel injector is also provided. The method comprises providing a fuel injector installed in an internal combustion engine. The fuel injector includes a fuel metering member having first and second ends disposed along a longitudinal axis, a seat located within the fuel metering member proximate the second end. The seat has a seat opening. The fuel injector also includes a needle reciprocably disposed within the fuel metering member. The needle has a longitudinal needle axis. The fuel injector also includes a guide disposed within the fuel metering member proximate to the seat. The guide includes a generally planar disk having a first surface, a second surface, and an outer perimeter being secured to the fuel metering member, a generally concentric central opening extending therethrough, the central opening guiding the needle, and at least one opening extending between the first and second surfaces. The at least one opening at the first surface is disposed at a first longitudinal distance from the seat opening. The outer perimeter is disposed at a second longitudinal distance from the seat opening. The first longitudinal distance is greater than the second longitudinal distance. The method further comprises operating the fuel injector; stopping the fuel injector; and allowing vapor bubbles formed between the guide and the seat to flow through the at least one opening.

BRIEF DESCRIPTION OF THE DRAWINGS

The accompanying drawings, which are incorporated herein, and constitute part of this specification, illustrate the presently preferred embodiment of the invention, and, together with the general description given above and the detailed description given below, serve to explain the features of the invention. In the drawings.

DETAILED DESCRIPTION OF THE PREFERRED EMBODIMENTS

Figure 1:
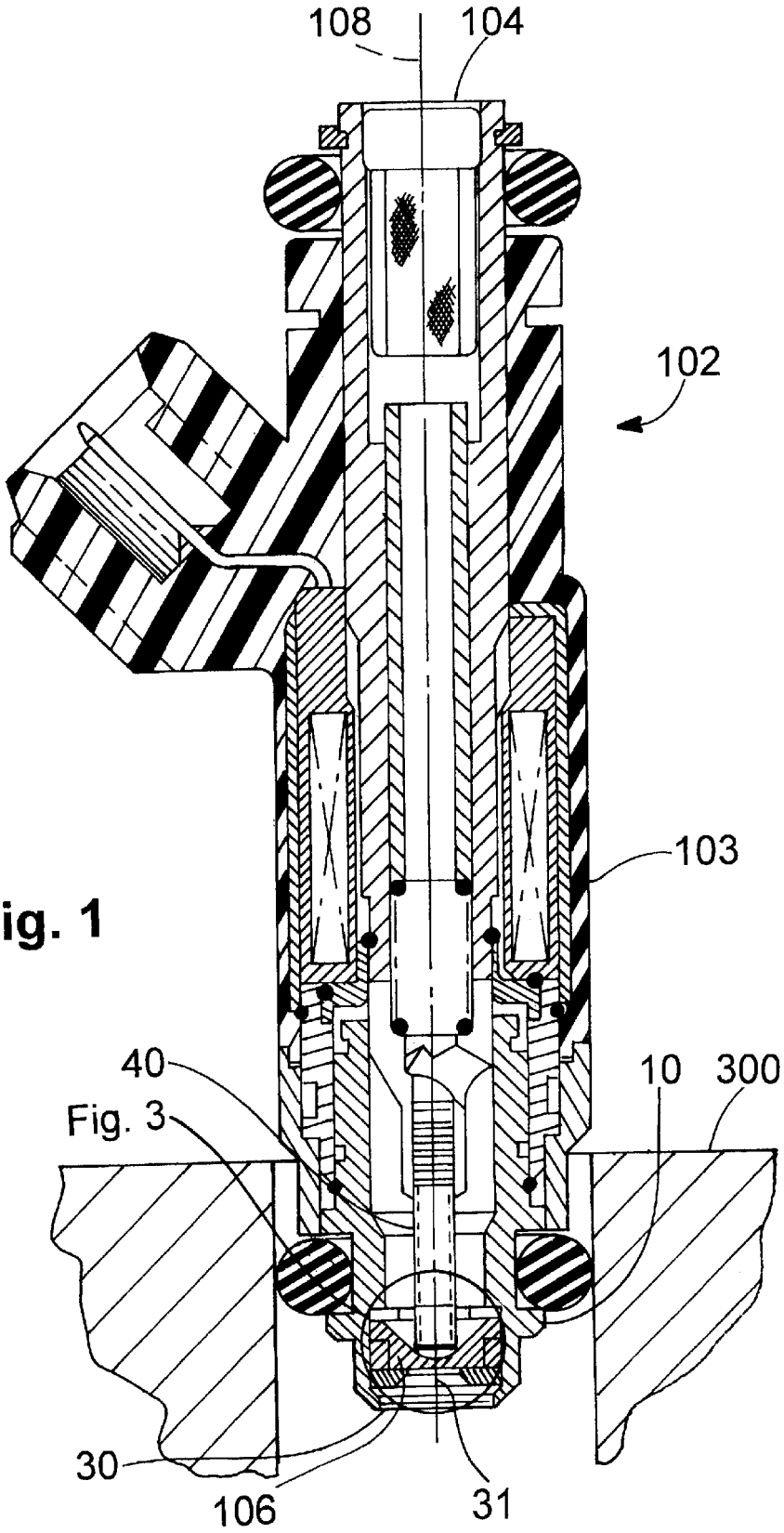
FIG. 1 is a profile view, in section, of a fuel injector in which a guide disk according to the present invention can be used.

Fuel injectors are used to provide a metered amount of fuel in an internal combustion engine. During engine operation, a fuel pump (not shown) provides the fuel to a fuel injector 102 mounted in an engine 300, which is shown in FIG. 1. As used herein, like numerals indicate like elements throughout.

The fuel injector 102 includes a first, or upstream end 104, a second, or downstream end 106 which is distal from the upstream end 104, and a longitudinal axis 108 which extends between the upstream and downstream ends 104, 106. As used herein, the term "upstream" is defined to mean toward the top of the fuel injector 102 shown in FIG. 1, while "downstream" is defined to mean toward the bottom of the fuel injector 102 shown in FIG. 1. The fuel injector 102 further includes a metering member 103, which extends generally from the upstream end 104 to the downstream end 106. The metering member 103 generally comprises multiple components, such as a valve body, a non-magnetic shell, an overmold and other components. However, for the purposes of this disclosure, all of these elements together are collectively recited as the metering member 103. The fuel injector 102 further includes a seat 30 located within the metering member 103 proximate to the downstream end 106, and a guide 10 which is located in the metering member 103 immediately upstream of the seat 30. The seat 30 has a seat opening 31 disposed along the longitudinal axis 108. The fuel injector 102 also includes a needle 40 which reciprocates within the metering member 103 along a longitudinal needle axis 108 between an open position in which the needle 40 is separated from the seat 30 to provide fuel to the engine 300 and a closed position in which the needle 40 is engaged with the seat 30 to restrict fuel to the engine 300.

During reciprocation of the needle 40, the guide 10 maintains axial alignment of the needle 40 with respect to the seat 30. A fuel injector in which the present invention can be used is disclosed in U.S. Pat. No. 5,775,600, which is incorporated herein by reference in its entirety. Additionally, those skilled in the art will recognize that the present invention can be used in other fuel injector designs, as well.

Figure 2:
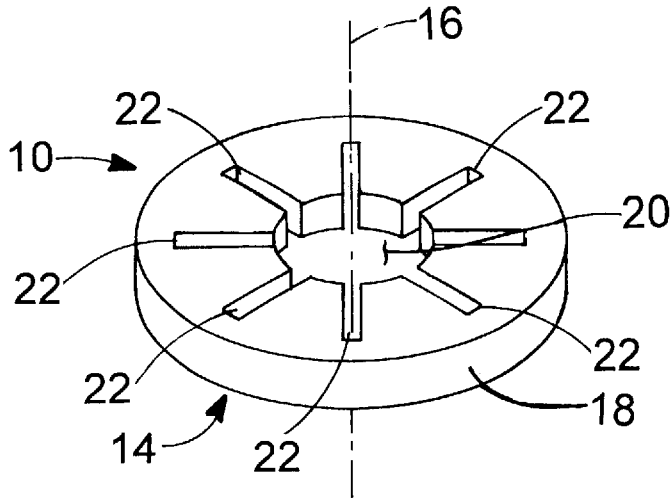
FIG. 2 is a perspective view of the guide disk according to a first embodiment of the preferred invention.
Figure 3:
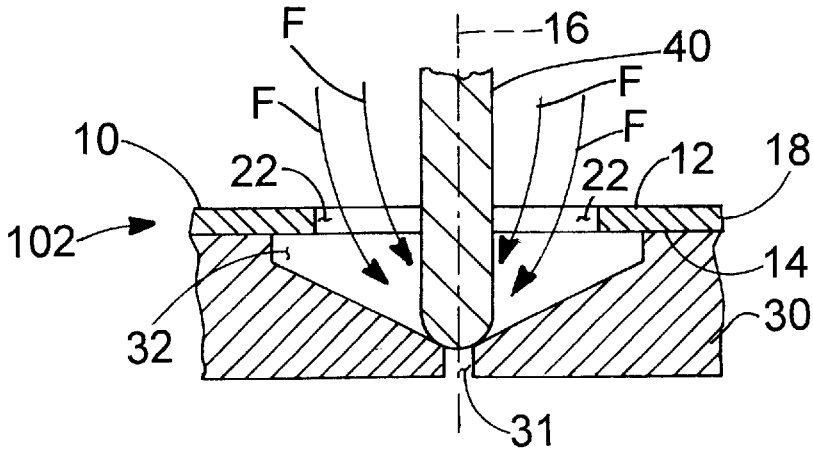
FIG. 3 is an enlarged side view, in section, of the guide disk shown in FIG. 1, inserted into the fuel injector.

A first preferred embodiment of the guide 10 is shown in FIG. 2. Preferably, the guide 10 is used as a lower guide for the reciprocating needle 40 in the fuel injector 102 as shown in FIG. 3, although those skilled in the art will recognize that the guide 10 can be used in other applications as well.

The guide 10 is preferably a thin, generally planar disk and includes a first, or upstream surface 12, a second, or downstream surface 14, and a longitudinal needle axis 16 extending therethrough. The guide 10 also includes an outer perimeter 18. Preferably, the outer perimeter 18 is circular, although those skilled in the art will recognize that the outer perimeter 18 can be other shapes as well. The outer perimeter 18 is connected to the metering member 103. The guide 10 also includes a generally concentric central opening 20 which extends therethrough along the longitudinal axis 16 through the guide 10, between the first surface 12 and the second surface 14. The central opening 20 is preferably circular and is sized to allow the needle 40 to reciprocate therein and guide the needle 40 during operation of the fuel injector 102.

The guide 10 also includes a plurality of inner openings, or slots 22 which extend between the first and second surfaces 12, 14, respectively, from the central opening 20 toward the outer perimeter 18, but do not extend all of the way to the outer perimeter 18. Preferably, the slots 22 extend generally parallel to the longitudinal needle axis 108. Although eight inner slots 22 are shown, those skilled in the art will recognize that more or less than eight inner slots 22 can be used. Preferably, the slots 22 extend radially from the central opening 20, although those skilled in the art will recognize that the slots 22 can extend in other directions, such as tangential to the central opening 20. The number of slots 22 is generally a function of the rigidity of the guide 10, which itself is generally a function of the thickness of the guide 10 between the upstream and downstream surfaces 12, 14, respectively, as well as the material from which the guide 10 is made. Preferably, the slots 22 are formed by at least one of a variety of known techniques, including, but not limited to, laser cutting, etching, punching, or other known techniques. Also preferably, the guide 10 is made from stainless steel, although those skilled in the art will recognize that other materials which are compatible with fossil fuels can be used.

Additionally, the size and number of the slots 22 is selected so as not to inhibit flow of fuel through the guide 10 during operation of the fuel injector 102. Preferably, it is desired that a flow area formed by the slots 22 is a substantial multiple of the flow area uncovered by the needle 40 at the seat 30 when the fuel injector 102 is in an open position.

Also, although the inner slots 22 are shown a symmetrically spaced about the central opening 20, those skilled in the art will also recognize that the inner slots 22 need not be symmetrically spaced about the central opening 20. As shown in FIG. 3, the slots 22 allow fuel "F" to flow from an upstream end of the fuel injector 102 to a downstream end of the fuel injector 102.

Also as seen in FIG. 3, a void 32 can be formed downstream of the disk 10 and between each inner slot 22 and the seat 30. Those skilled in the art will recognize that the size of the void 32 can be regulated by the radial length of each inner slot 22 from the central opening 20, and that the void 32 can be eliminated altogether by making the length of each inner slot 22 sufficiently long so as to engage or overlap an upstream end of the seat 30.

Operation of the guide 10 in the fuel injector 102 is as follows. Typically, the fuel injector 102 is inserted into the engine 300 at an angle relative to the vertical, as shown in FIG. 1, so that the needle axis 16 is also at an angle relative to the vertical. Because of the angle of the fuel injector 102, at least one slot 22 at the upstream surface 12 of the disk 10 is located a first longitudinal, or vertical, distance from the seat opening 31 and the outer perimeter 18 proximate to the at least one slot 22 is located a second longitudinal, or vertical, distance from the seat opening 31, such that the first longitudinal distance is greater than the second longitudinal distance. As shown in FIG. 1, the slot 22 at the upstream surface 12 on the left hand side of the fuel injector 102 is higher than the outer perimeter 18 of the disk at the upstream surface 12 between the needle 40 and the outer perimeter 18 of the disk on the left hand side of the fuel injector 102.

A fuel pump (not shown) provides fuel to the upstream end 104 of the fuel injector 102. The fuel flows downstream through the fuel injector 102 to the upstream surface 12 of the disk 10. The fuel then flows through the slots 22, as well as any space in the central opening 20 between the needle 40 and the disk 10. The fuel then flows to the interface of the needle 40 and the seat 30. During operation of the fuel injector 102, when the needle 40 is in an open position, the fuel flows through an opening in the seat 30 for injection into the engine 300.

When the engine 300 is stopped, fuel flow through the fuel injector 102 is also stopped. Heat generated by the engine 300, which has been conducted to the fuel injector 102, during operation, heats fuel within the fuel injector 102.

At least some of the fuel which is closer to the combustion chamber, generally the fuel downstream of the disk 10, tends to vaporize. Further, the vaporized fuel, being less dense than the liquid fuel, as is recognized by those skilled in the art, flows upstream through the inner slots 22 and to a portion of the fuel injector 102 upstream of the disk 10.

Any vaporized fuel which may be located in the volume of the void 32 is either drawn up through the inner slots 22 with the previously described vaporized fuel, or is of such a small amount so as to not interfere with fuel flow through the fuel injector 102 in the event that the engine 300 is restarted while still hot.

Figure 4:
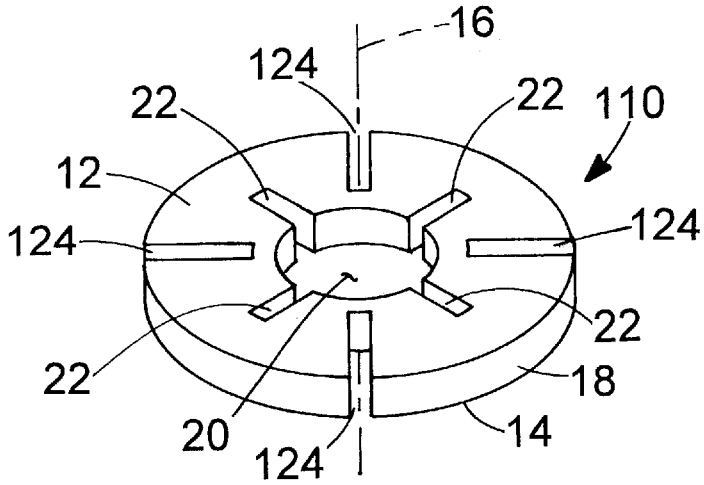
FIG. 4 is a perspective view of a guide disk according to a second embodiment of the preferred invention.

A second embodiment of a guide 110 is shown in FIG. 4. The guide 110 is preferably identical to the guide 10, with the addition of a plurality of outer openings or slots 124 which extend between the first and second surfaces 12, 14, respectively, from the outer perimeter 18 toward the central opening 20, but do not extend all the way to the central opening 20. Preferably, the outer slots 124 alternate with the inner slots 22 around the guide 110, although those skilled in the art will recognize that the outer slots 124 and the inner slots 22 can be spaced in other locations relative to each other. Preferably, the slots 124 extend radially toward the central opening 20, although those skilled in the art will recognize that the slots 124 can extend in other directions, such as spirally from the outer perimeter 18.

Operation of the second embodiment of the guide 110 is generally the same as the operation of the guide 10 as described above, with the additional feature of that any vaporized fuel which may have been trapped in the void 32 in the first embodiment can flow upstream through the outer slots 124, providing a more efficient method of eliminating vaporized fuel from the void 32. Additionally, in the event that the fuel injector 102 is tilted, such as in an automobile engine 300 on a slope, the outer slots 124 may provide a high spot in the disk 10 relative to the outer perimeter 18. Such a high spot is a natural location for fuel vapors to collect and thus be discharged from the downstream end of the disk 10.

Figure 5:
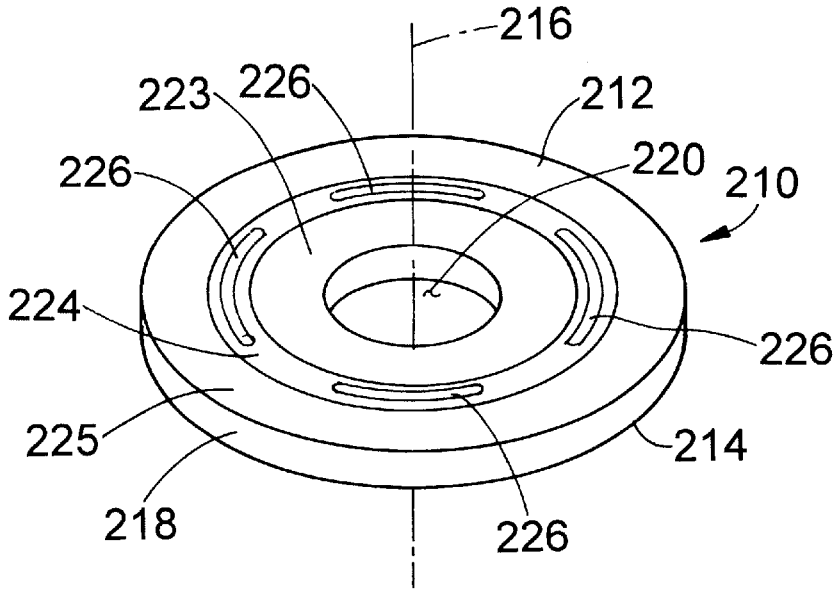
FIG. 5 is a perspective view of a guide disk according to a third embodiment of the preferred invention.
Figure 6:
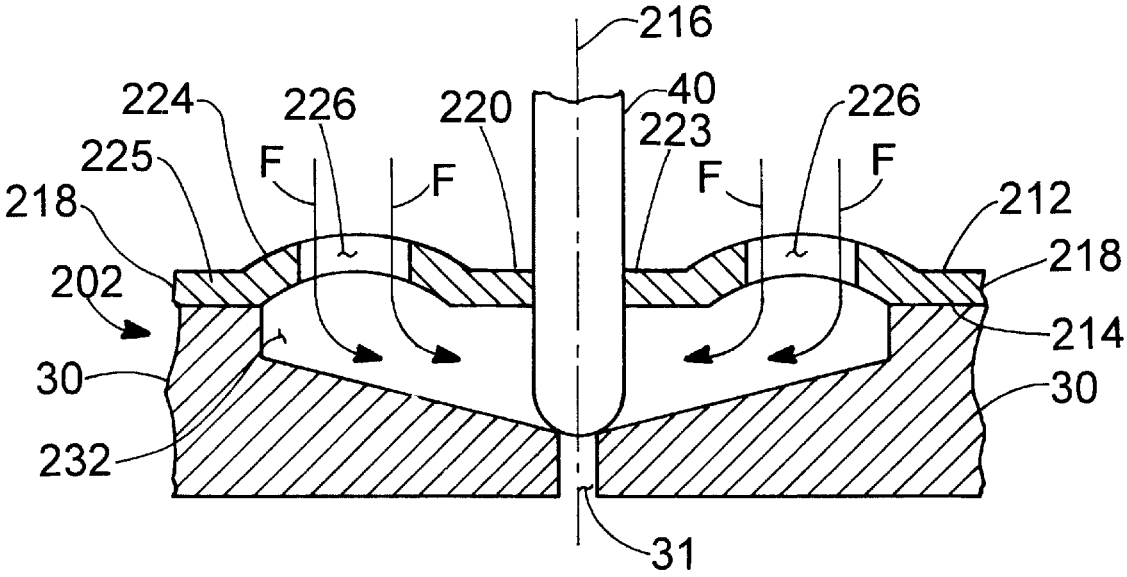
FIG. 6 is a partial side view, in section, of the guide disk shown in FIG. 5, inserted into a fuel injector.

A third embodiment of a guide 210 is shown in FIG. 5, with the guide 210 installed in a partial sectional view of a fuel injector 102 shown in FIG. 6. The guide 210 is preferably a generally planar disk and includes a first, or upstream surface 212, a second, or downstream surface 214, and a longitudinal axis 216 extending therethrough. The guide 210 also includes an outer perimeter 218. Preferably, the outer perimeter 218 is circular, forming the guide 210 as a cylinder, although those skilled in the art will recognize that the outer perimeter 218 can be other shapes as well. The guide 210 also includes a generally concentric central opening 220 which extends therethrough along the longitudinal axis 216 through the guide 210, between the first surface 212 and the second surface 214. The central opening 220 is sized to allow a reciprocating element, such as the needle 40, to reciprocate therein.

The first surface 212 includes a generally annular curvilinear portion 224 which circumscribes the central opening 220 and is generally spaced between the central opening 220 and the outer perimeter 218. Preferably, a first portion 223 of the first surface 212 extends between the generally central opening 220 and the curvilinear portion 224, and a second portion 225 of the first surface 212 extends between the curvilinear portion 224 and the outer perimeter 218. The curvilinear portion 224 includes a plurality of generally arcuate openings or slots 226 which are spaced around the curvilinear portion 224. The slots 226 are located in the most upstream portion of the curvilinear portion 224, as shown in FIG. 6 such that each slot 226 at the first surface 212 is disposed a first longitudinal distance from the seat opening 31, and the outer perimeter 218 is disposed a second longitudinal distance from the seat opening 31, with the first distance being greater than the second distance.

Preferably, each of the slots 226 extends generally parallel to a longitudinal needle axis 216. As shown in FIG. 5, preferably four slots 226 are located in the curvilinear portion 224, although those skilled in the art will recognize that more or less than four slots 226 can be used.

A void 232 can be formed downstream of the disk 210 and between each slot 226 and the seat 30. Those skilled in the art will recognize that the size of the void 232 can be regulated by the width of each slot 226 from the central opening 220, and that the void 232 can be eliminated altogether by making the width of each slot 226 sufficiently wide so as to engage or overlap an upstream end of the seat 30.

Operation of the third embodiment of the guide 210 is as follows. The engine 300 is operated, and then stopped. Any vaporized fuel which forms in the void 232 as a result of operation of the engine 300 naturally tries to flow upstream as a result of the density differences between the vaporized fuel and liquid fuel, as is recognized by those skilled in the art. The vaporized fuel encounters the second surface 214 of the disk 210 and flows upstream along the generally annular curvilinear portion 224. The vaporized fuel then flows through the slots 226 to a portion of the fuel injector 102 upstream of the disk 210, where the vaporized fuel will not have an adverse affect on any subsequent hot starts.

The present invention, as described above, provides a direct and straight path between a fuel source and the seat 30, while providing an escape path for any bubbles which may form downstream of the disk 10, 110, 210.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined in the appended claims.

What is claimed is:

1. A fuel injector comprising:

a fuel metering member having first and second ends disposed along a longitudinal axis;

a seat located within the fuel metering member proximate the second end;

a closure member reciprocably disposed within the fuel metering member, the closure member having a longitudinal closure member axis; and a guide disposed within the fuel metering member proximate to the seat, the guide including:

a generally planar disk having a first surface, a second surface, an outer perimeter;

a generally concentric central opening having wall surfaces exposed to the longitudinal axis to guide the closure member along the longitudinal axis; and at least one inner opening extending from the wall surfaces between the first and second surfaces, the at least one inner opening extending along a plane generally parallel to and through the longitudinal axis from the central opening toward the outer perimeter.

2. A fuel injector comprising:

a fuel metering member having first and second ends disposed along a longitudinal axis;

a seat located within the fuel metering member proximate the second end;

a closure member reciprocably disposed within the fuel metering member, the closure member having a longitudinal closure member axis; and a guide disposed within the fuel metering member proximate to the seat, the guide including:

a generally planar disk having a first surface, a second surface, an outer perimeter;

a generally concentric central opening extending therethrough, the central opening being sized to allow the reciprocating element to reciprocate therein;

at least one inner opening extending between the first and second surfaces from the central opening toward the outer perimeter, the at least one inner opening extending generally parallel to the longitudinal axis; and at least one outer opening extending from the outer perimeter toward the central opening.

3. The fuel injector according to claim 2, wherein the at least one outer opening extends radially toward the central opening.

4. The fuel injector according to claim 1, wherein the at least one inner opening extends radially toward the outer perimeter.

5. The fuel injector according to claim 1, wherein the outer perimeter is generally circular.

6. A fuel injector comprising:

a fuel metering member having first and second ends disposed along a longitudinal axis;

a seat located within the fuel metering member proximate the second end;

a closure member reciprocably disposed within the fuel metering member, the closure member having a longitudinal closure member axis; and a guide disposed within the fuel metering member proximate to the seat, the guide including:

a generally planar disk having a first surface, a second surface, and an outer perimeter being secured to the fuel metering member;

a generally concentric central opening having wall surfaces exposed to the longitudinal axis to guide the closure member along the longitudinal axis; and at least one opening extending between the first and second surfaces, the at least one opening at the first surface being disposed at a first longitudinal distance from the seat opening, the outer perimeter being disposed at a second longitudinal distance from a seat opening, the first distance being greater than the second distance, the at least one inner opening extending along a plane generally parallel to and through the longitudinal axis from the central opening toward the outer perimeter.

7. The fuel injector according to claim 6, wherein the first surface includes a curvilinear portion between the central opening and the outer perimeter, wherein at least one opening extends through the curvilinear portion.

8. The fuel injector according to claim 7, wherein the at least one opening is generally arcuate.

9. The fuel injector according to claim 8, wherein the at least one opening extends generally parallel to the longitudinal closure member axis.

10. A method of evacuating vapor bubbles proximate a valve seat in a fuel injector comprising:

providing a fuel injector installed in an internal combustion engine, the fuel injector including:

a fuel metering member having first and second ends disposed along a longitudinal axis;

a seat located within the fuel metering member proximate the second end, the seat having a seat opening;

a closure member reciprocably disposed within the fuel metering member, the closure member having a longitudinal closure member axis; and a guide disposed within the fuel metering member proximate to the seat, the guide including:

a generally planar disk having a first surface, a second surface, and an outer perimeter being secured to the fuel metering member;

a generally concentric central opening having wall surfaces exposed to the longitudinal axis to guide the closure member along the longitudinal axis; and at least one opening extending between the first and second surfaces, the at least one opening at the first surface being disposed at a first longitudinal distance from a seat opening, the outer perimeter being disposed at a second longitudinal distance from the seat opening, the first longitudinal distance being greater than the second longitudinal distance, the at least one inner opening extending along a plane generally parallel to and through the longitudinal axis from the central opening toward the outer perimeter;

operating the fuel injector;

stopping the fuel injector; and allowing vapor bubbles formed between the guide and the seat to flow through the at least one opening.

11. The method according to claim 10, further comprising forming the at least one opening from the central opening toward the outer perimeter.

12. The method according to claim 11, wherein forming the at least one opening comprises extending the at least one opening radially toward the outer perimeter.

13. The method according to claim 11, further comprising forming at least a second outer opening extending from the outer perimeter toward the central opening.

14. The method according to claim 13, wherein forming the at least second opening comprises extending the at least second opening radially toward the central opening.

15. The method according to claim 10, further comprising providing the first surface including a curvilinear portion on the first surface between the central opening and the outer perimeter, the at least one opening extending through the curvilinear portion.

16. The method according to claim 15, further comprising the first surface including a first planar portion and a second planar portion, the curvilinear portion being disposed between the first planar portion and the second planar portion.

17. The fuel injector according to claim 16, wherein the at least one opening is generally arcuate.

18. A fuel injector comprising:

a fuel metering member having first and second ends disposed along a longitudinal axis;

a seat located within the fuel metering member proximate the second end;

a closure member reciprocably disposed within the fuel metering member, the closure member having a longitudinal closure member axis; and a guide disposed within the fuel metering member proximate to the seat, the guide including:

a generally planar disk having a first surface, a second surface, and an outer perimeter being secured to the fuel metering member;

a generally concentric central opening extending therethrough, the central opening guiding the closure member;

at least one opening extending between the first and second surfaces, the at least one opening at the first surface being disposed at a first longitudinal distance from the seat opening, the outer perimeter being disposed at a second longitudinal distance from the seat opening, the first distance being greater than the second distance; and at least one outer opening extending from the outer perimeter toward the central opening.

* * * * *